United States Patent [19]

Cruse

[11] 4,447,296

[45] May 8, 1984

[54] DOUBLE NIP HYDROFOIL

[75] Inventor: Aubrey R. Cruse, Pasadena, Tex.

[73] Assignee: Champion International Corporation, Stamford, Conn.

[21] Appl. No.: 363,234

[22] Filed: Mar. 29, 1982

[51] Int. Cl.[3] ..... D21F 1/54

[52] U.S. Cl. ..... 162/312; 162/352

[58] Field of Search ..... 162/209, 211, 308, 312, 162/352, 374

[56] References Cited

U.S. PATENT DOCUMENTS

| | | | |
|---|---|---|---|
| 3,377,236 | 4/1968 | Roecker | 162/352 X |
| 3,874,998 | 4/1975 | Johnson | 162/209 X |
| 4,306,934 | 12/1981 | Seppanen | 162/209 |

FOREIGN PATENT DOCUMENTS

| | | | |
|---|---|---|---|
| 2229509 | 1/1973 | Fed. Rep. of Germany | 162/352 |
| 457764 | 2/1975 | U.S.S.R. | 162/352 |

OTHER PUBLICATIONS

Thorp, "Hydrofoil Design . . . ," Paper Trade Journal, vol. 149, No. 2, Jan. 11, 1965, pp. 37–41.

*Primary Examiner*—Richard V. Fisher

*Attorney, Agent, or Firm*—Evelyn M. Sommer

[57] ABSTRACT

An improved hydrofoil for use in a paper forming apparatus, such as a fourdrinier, is provided with a nip on both the trailing edge and leading edge. The nip on the trailing edge is provided in a standard manner for desired drainage, while the nip in the leading edge of the foil is provided to "pump" water back into the paper material to break up wire side flocs.

1 Claim, 3 Drawing Figures

DOUBLE NIP HYDROFOIL

BACKGROUND OF THE INVENTION

The present invention is directed to the field of paper forming machines, and more particularly to hydrodynamic foils employed in open wire paper formers, such as the fourdrinier wire section.

The fourdrinier wire section or open wire paper former is the oldest and still most widely used paper forming method, and briefly involves the deposition of a fiber suspension onto an endless wire mesh running horizontally. The water drains through the mesh, while the majority of the fibers are retained by the wire. At the end of the table, most of the water has been drained from the sheet, and the sheet is separated from the endless wire and collected in rolls.

One of the techniques for removing the water from the sheet is through the use of a device commonly referred to as a table roll. Initially, table rolls were used because they offer the best way to support the wire with the least resistance to moving it. However, it was shown that the table roll creates a vacuum in the water filled gap, or nip, between the wire and the roll, thus making it a very powerful drainage tool. However, the intense pressure drop encountered by the wire when moving over the roll creates very high vertical acceleration forces and thus may tend to disturb the sheet, form ridges, and spout at high speeds.

Another technique for removing water from the sheet which has been increasing in popularity, is the use of hydrofoils or "foils". Prior art foils are stationary blades held in contact with the wire at the front end and diverging from the wire to form a nip at the trailing end at angles typically varying between one and five degrees. The same hydrodynamic principles inherent in the table roll are also present in the use of foils, the diverging nip being functionally equivalent to the trailing portion of the table roll. However, due to the stationary nature of the foil, the vacuum attained over the foil nip is significantly less than the amount which can be developed on a table roll, and the foil is a less efficient drainage element relative to the table roll for this reason. However, the nip on the foil can be much longer than the effective nip of the table roll, and the number of foils along the table can be varied to thereby offset the drainage capability of the foil relative to the table roll. Also, by varying the foil angle, the magnitude of the drainage can be easily controlled, thereby reducing disturbances during the paper forming process. The lower levels of disturbance available with the use of foils results in better formation, less two-sidedness, better retention, increased speed limit, reduced loss of additives or fines from the wire side of the sheet. Further, the use of the double nip hydrofoil substantially increases the water removal capacity of the Fourdrinier allowing the lowering of headbox consistency.

By adjusting the angle of inclination of the trailing end of the foil, particular operating characteristics can be achieved. For example, if maximum water removal is the only goal, the use of a long blade with an approximately 2° angle at the beginning of the foil station and the use of a foil with an approximately 1° angle at the end of the foil station will probably be used. However, common practice is to install alternate foils of varying angles along the wire path in order to optimize the rate of water removal without creating excessive sheet disturbance and high loss of fines.

Despite the judicious use of the above described foils having the nip at the trailing end of the foil, improvement of paper formation on the fourdrinier is still desired. Specifically, it has been found that under certain circumstances, the dispersion of flocs initially formed on the wire side cannot be achieved without significant mat disruption and removal of fines from the wire side. Additionally, when attempting to reduce the rate of water removal in order to eliminate excessive sheet disturbance and loss of fines, removal of too little water may result in the phenomenon known as "sealing" of the sheet on the wire, making subsequent water removal more difficult. Additionally, flow streaks from the slice rectifier roll, and uneven edges, are many times problems encountered in the use of prior art machines.

OBJECTS AND SUMMARY OF THE INVENTION

It is therefore an object of the invention to provide a new foil design which provides results superior to those accomplished by the prior foil designs.

It is a further object to provide a new foil design which allows an optimum formation of composition weight, grade, and condition of paper.

It is a further object to provide a new foil design for use in a fourdrinier wire section or open wire former.

It is a further object to provide a new foil design which allows enhanced dispersion of wire side hard flocs without mat disruption and extreme fines removal.

It is a further object to provide a new foil design for use on the Fourdrinier wire section or open wire former which provides enhanced sealing characteristics during water removal.

It is a further object of the invention to provide a new foil design for use on the Fourdrinier wire section or open wire formers which reduces flow streaks and improves the edges of paper formed thereon.

In accordance with a first aspect of the invention, a hydrofoil having upstream and downstream edges for use in a paper forming apparatus is adapted to be positioned underneath a paper forming wire which moves from the upstream to the downstream edge. The hydrofoil includes a top surface adapted to support the paper forming wire and a leading inclined portion formed along the upstream edge of the hydrofoil and intersecting the top surface at an angle greater than 90°.

The hydrofoil may further include a trailing inclined portion formed along the downstream edge of the hydrofoil and intersecting the top surface at an angle greater than 90°.

Preferably, the angle between the leading inclined portion and the paper forming wire is less than approximately 6°, the length of the leading inclined portion measured along the wire is less than approximately 2", and both the leading inclined portion and the top surface are substantially planar.

In accordance with a second aspect of the invention, a paper forming apparatus, having a paper forming wire which moves from upstream to downstream sides of the apparatus, includes a hydrofoil having upstream and downstream edges and a top surface disposed below and adjacent to the wire for removing water from paper material on top of the wire. In accordance with the invention, the improvement in the paper forming apparatus includes means associated with the hydrofoil for directing water into the paper material through the wire to thereby improve the quality of the paper material.

Preferably, the associated means is integral with the hydrofoil and includes an inclined portion formed along the upstream edge of the hydrofoil and intersecting the top surface at an angle greater than 90°.

In accordance with a third aspect of the invention, a process for improving the quality of paper material produced by a paper forming apparatus having a paper forming wire with paper material thereon, includes the steps of (i) moving the wire from upstream and downstream sides, and (ii) alternately removing water from, and forcing water into, the paper material through the wire.

DETAILED DESCRIPTION OF THE INVENTION

Figure 2:
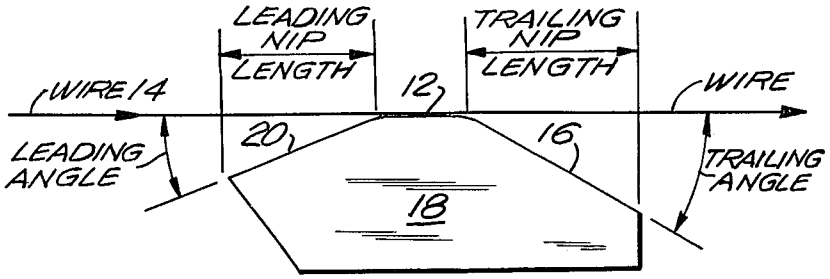
Figure 1:
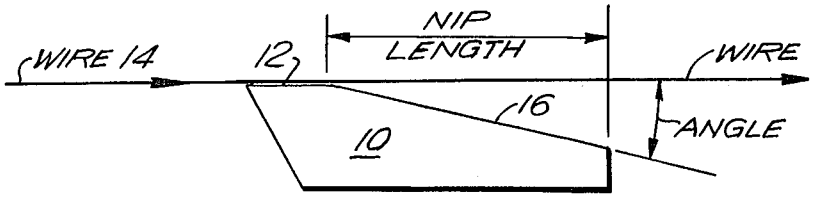
(PRIOR ART) FIG. 1
Figure 3:
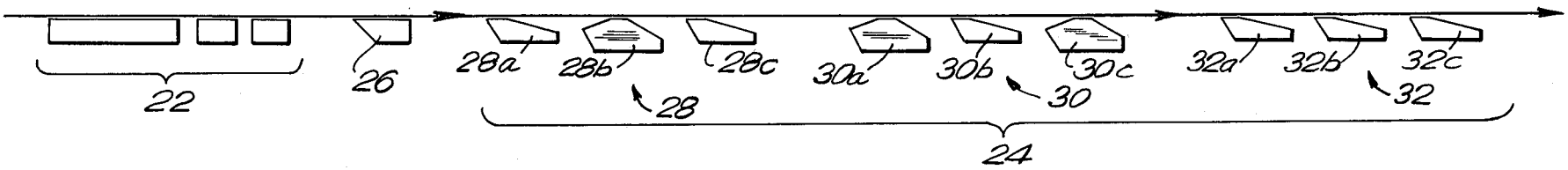

The various apsects of the invention will become more apparent from the following detailed description of a preferred embodiment of the invention taken in conjunction with the accompanying drawings, in which:

FIG. 1 is a somewhat schematic side elevational view of a hydrafoil formed in accordance with the teachings of the prior art and which includes only a downstream nip;

FIG. 2 is a somewhat schematic side elevational view of a hydrofoil formed in accordance with the invention and which includes both an upstream nip and a downstream nip; and FIG. 3 is a somewhat schematic side elevational view of an improved paper forming apparatus formed in accordance with this invention and including alternating hydrofoils of the type shown in FIG. 1 and intermediate hydrofoils of the type shown in FIG. 2.

FIG. 1 illustrates a prior art foil 10 having a generally planar top surface 12 in contact with wire cloth 14 which travels over the foil 10 from an "upstream" side to a "downstream" side, or from left to right as shown in the figure. The wire cloth 14 may be any of the woven metal or synthetic fiber materials as commonly employed in the art. The foil 10 is provided with a generally planar nip portion 16 having a horizontal length, and extending downwardly away from the wire 14 at a predetermined angle therefrom. Water removal from the mat is hydrodynamically achieved at the nip portion 16 in a manner well known in the art.

It has been found that preformed flocs formed shortly after delivery can be redispersed without severe mat disruption and wire side fines removal experienced with table rolls by pumping back a small but effective amount of water into the mat and subsequently removing it therefrom. The foil in accordance with the present invention accomplishes this function and is illustrated in FIG. 2. Foil 18 includes the standard nip 16 (hereinafter the "trailing" nip) and an additional "leading" nip 20 formed along the leading or upstream end of the foil. Leading nip 20 is generally planar and intersects the top surface 12 at an angle considerably greater than 90°, thereby providing an acute "leading" angle between the nip 20 and the wire 14. Similarly defined, trailing nip 16 intersects the top surface 12 at an angle greater than 90° to provide an acute "trailing" angle.

Wire cloth 14 is in contact with the generally planar top surface 12 of foil 18, and the desired amount of water is drained from the paper as the wire moves over the trailing nip 16 having a predetermined length and trailing angle, in a manner identical to that described with reference to the prior art foil 10, in order to provide the desired drainage and activity. However, prior to this drainage and activity the leading nip 20, having the predetermined length and leading angle, hydrodynamically "pumps" back into the wire a small but effective amount of water to thereby break up and disperse flocs initially formed on the wire side, without disrupting the mat or removing extreme fines from the wire side, resulting in a reduction in flow streaks, dispersion of wire side hard flocs, improved sheet seal, and the production of an extremely flat and smooth felt side.

It is the combination of the hydrodynamic "water pump back" function provided by the leading nip, immediately followed by the subsequent water removal action of the trailing nip which provides the above described advantages. The combination of leading and trailing lengths and leading and trailing nip angles will become apparent to those skilled in the art for any particular combination of desired characteristics of the end product, such as smoothness, floc dispersion, etc., through routine experimentation. However, in order to explicitly describe a preferred embodiment for providing the overall best and most uniform formation for composition weight, grade, and condition, reference will be made to FIG. 3.

FIG. 3 illustrates the form board and foil station portions of the paper forming apparatus, such as the fourdrinier. Specifically, the forming board portion 22 of the apparatus delivers the wire 14 having the wet stock thereon to the foil station 24 via a single deflector blade 26. The foil station 24 comprises three foil units 28, 30 and 32, each having three individual foils, 28*a*, 28*b*, 28*c*; 30*a*, 30*b*, and 30*c*; and 32*a*, 32*b* and 32*c*, respectively. As shown in FIG. 3, blades 28*b*, 30*a*, and 30*c* are designed in accordance with the present invention, having both a leading and trailing nip, while the remaining blades, 28*a*, 28*c*, 30*b* and 32*a*–32*c* are of the prior art type, having only a trailing nip. In accordance with the preferred embodiment, the approximate nip lengths and angles are described in the following Table:

TABLE

| | LEADING NIP | | TRAILING NIP | |
|---|---|---|---|---|
| FOIL | LENGTH | ANGLE | LENGTH | ANGLE |
| 28a | — | — | 1,5" | 3° |
| 28b | 1.5" | 3° | 2.0" | 4° |
| 28c | — | — | 1.5" | 3° |
| 30a | 1.5" | 3° | 2.0" | 4° |
| 30b | — | — | 2.0" | 4° |
| 30c | 1.5" | 3° | 2.0" | 4° |
| 32a | — | — | 2.0" | 4° |
| 32b | — | — | 3.625" | 2° |
| 32c | — | — | 3.625" | 2° |

It should be noted that the example described with reference to FIG. 3 and the above Table is merely exemplary of one such system which provides the benefits obtainable through the use of the foil in accordance with the present invention. Other individual foil designs, and arrangements of the foils within the foil station will be apparent to those skilled in the art.

Although the invention has been described with respect to specific embodiments, modifications and alterations may be made to the specific embodiments, without departing from the spirit and scope of the invention as defined in the following claims.

What is claimed is:

1. A paper forming apparatus having a paper forming wire which moves from upstream to downstream sides of said apparatus, said apparatus further comprising a series of hydrofoils disposed below said wire and over which said wire passes, and wherein:

(a) alternate ones of said hydrofoils include a planar upper surface and an upstream planar surface which intersects said planar upper surface at an angle which is less than 90° whereby the upstream ends of said alternate hydrofoils are devoid of a leading nip, and said alternate hydrofoils further comprising an upper downstream planar surface which tapers downwardly to form a trailing nip operable to draw water through said wire from paper material disposed on said wire; and (b) intermediate ones of said hydrofoils are disposed between said alternate hydrofoils, and said intermediate hydrofoils each including a planar upper surface, an upstream inclined planar upper surface which intersects said planar upper surface to form an upstream nip having an effective angle of approximately 3° and a length of approximately 1.5 inches on said intermediate hydrofoils operable to pump water from the underside of said wire through said wire and into paper material disposed on said wire to break up and redisperse flocs formed in the paper material, said intermediate hydrofoils further comprising an upper downstream planar surface which tapers downwardly to form a trailing nip operable to draw the water pumped by said upstream nip back through said wire from the paper material disposed on said wire.

* * * * *